US009908035B1

(12) United States Patent
Clark et al.

(10) Patent No.: US 9,908,035 B1
(45) Date of Patent: Mar. 6, 2018

(54) GAME FOR A PLURALITY OF PLAYERS, AND METHOD OF PLAY

(76) Inventors: Kelly A Clark, Brunswick, GA (US); Joshua L Clark, Brunswick, GA (US)

( * ) Notice: Subject to any disclaimer, the term of this patent is extended or adjusted under 35 U.S.C. 154(b) by 845 days.

(21) Appl. No.: 13/429,907

(22) Filed: Mar. 26, 2012

Related U.S. Application Data

(60) Provisional application No. 61/467,025, filed on Mar. 24, 2011.

(51) Int. Cl.
*A63F 3/00* (2006.01)

(52) U.S. Cl.
CPC ..... *A63F 3/00003* (2013.01)

(58) Field of Classification Search
CPC ..... A63F 3/0003; A63F 3/0006
USPC ..... 273/251, 252, 254
See application file for complete search history.

(56) References Cited

U.S. PATENT DOCUMENTS

2003/0094758 A1* 5/2003 Hardie et al. ..... 273/243

* cited by examiner

*Primary Examiner* — Vishu Mendiratta
(74) *Attorney, Agent, or Firm* — Jonathan R. Smith; Jonathan Rigdon Smith, J.D., PC

(57) ABSTRACT

A board game, also embodied in two or three dimension electronic display, is based on one of China's greatest works of literature, Journey to the West or Monkey. The preferred embodiment of the game of the instant invention allows from two to four players to compete through a combination of chance rolls of dice, chance draw of randomly-sequenced instruction cards, and exercise of strategy. The initial "movement roll" of two six-sided dice by each player begins advance of their game pieces along spaces around a closed path. When all of the game pieces have completed one round, a separate central character game piece may advance along a separate path that ends at a final goal. This requires repetitive circuits of the players' game pieces around the closed path.

7 Claims, 7 Drawing Sheets

GAME FOR A PLURALITY OF PLAYERS, AND METHOD OF PLAY

BACKGROUND OF INVENTION

Journey to the West is one of China's greatest works of literature. It is a novel based on a real life journey of a Chinese monk, known as either Tripitaka or Xuanzang, who is tasked to retrieve scriptures from India and bring them back to China. Along the way, he is accompanied by several larger than life companions: the Monkey King, known simply as Monkey, Pigsy the Pigman, Sandy the River Ogre, and the Dragon Prince. These characters do everything in their power to ensure their master Tripitaka remains safe during his journey, for if they succeed, not only do they redeem their past sins but they also have a chance at becoming enlightened beings.

In the Western part of the world, this folk tale is known commonly as Monkey, because much of the story focuses on the creation and antics of the character Monkey. He makes the story come alive with his childish nature, fierce temper, and unwavering loyalty. His tale of spiritual growth and determination has made him an endearing character not only to China, but to much of the rest of the world, and he is seen throughout much of today's popular media.

Although Monkey steals the show throughout much of the novel, what makes this novel a timeless work is the efforts made by all of the companions, who overcome their own weaknesses and find the strength to help their master succeed in his quest. Tripitaka's traveling companions cooperate and/or compete to become enlightened beings, all the while ensuring that Tripitaka eventually reaches his destination.

CHARACTERS:

TRIPITAKA (XUANZANG)

Tripitaka is a monk tasked to retrieve Buddhist scriptures from India and return them to China. The journey is perilous, and as he is physically weak, the Bodhisattva Guanyin sends four uncommonly strong companions to aid him.

MONKEY (SUN WUKONG)

Born out of a stone egg that lay dormant for ages atop the Flower Fruit Mountain, Monkey is incredibly strong, mischievous, and cunning. At one point in time he created havoc in Heaven itself, defeating 100,000 celestial soldiers. As penance for commotion he created in Heaven, he is eventually tasked to protect Tripitaka on his journey to India.

Of the companions, he is by far the strongest, and possesses the ability to transform into any creature or object in the mortal world. He wields an immensely heavy staff, which can grow to the size of a pillar, or shrink to the size of a needle.

PIGSY (ZHU BAJIE)

Pigsy was once a mighty general of Heaven who commanded 100,000 soldiers of the Milky Way. However, during a celebration of the gods, he flirted with the Moon Goddess, resulting in his banishment to Earth. Although he was supposed to be reincarnated as a human, he wound up as the offspring of a pig, giving him both human and pig features. Like Monkey, he is commanded to accompany Tripitaka on his journey to ensure his master's safety. His weapon, which he has carried since childhood, is an extremely durable muck rake, which he wields with great prowess.

SANDY (SHA WUJING)

Sandy was actually quite handsome in the past, when he stood in attendance as a curtain raising general in Heaven. This changed when he smashed a crystal goblet belonging to the Heavenly Queen Mother during the Peach Banquet. For this act, he was transformed into a river ogre and banished to the Flowing Sands River on Earth. Here he spent many years terrorizing local villagers, until Tripitaka came upon the river, at which point he joins the pilgrimage in exchange for redemption of his past sins. His weapon of choice is the monk's spade, and he excels at water combat.

DRAGON PRINCE (YULONG SANTAIZI)

After burning his father's great pearl, the Dragon Prince is sentenced to death. However, the Bodhisattva Guanyin stays the execution and instead commands him to wait for Tripitaka to appear and assist him. He waits in dragon form for many years, eating travelers and their horses. Because he has forgotten who he is waiting for, eventually he eats the horse of Tripitaka, and realizing who the rider is, apologizes and transforms into a replacement horse, carrying his master for the majority of his pilgrimage.

Because of the popularity of the story and its mythological historical value, a game has been devised in the present invention which can be played by a plurality of players, incorporating many of the above character traits and event scenarios, and utilizing rolls of dice or other random number generator to make possible an essentially endless variety of story lines.

BRIEF DESCRIPTION OF THE INVENTION

The preferred embodiment of the game of the instant invention allows from two to four players, each representing one or two of the four aforementioned characters, described as "companions" of the main character Tripitaka, to compete for the highest degree of enlightenment (determined by "Enlightenment Points" or "EPs") through a combination of chance rolls of dice, chance draw of randomly-sequenced playing cards, and exercise of strategy. The initial "movement roll" of two six-sided dice by each companion, in addition to the talents ascribed to each companion and the instructions provided on the cards, begins each companion's advance along spaces around a closed path. When all of the companions have completed one movement roll (i.e., a "round") the character Tripitaka may advance along a separate "journey" path (not connected to the closed path) that ends at a final goal ("Thunder Temple"). This requires repetitive circuits of the characters around the closed path.

Each companion may accumulate "gold" along the way which he/she may exchange for Enlightenment Points. Whichever character has the highest number of Enlightenment Points when Tripitaka reaches the Thunder Temple wins the game.

As described here, the game paths are drawn on a two-dimensional game board, and the characters are represented by game pieces that move on the board. It should be understood, however, that the instant invention includes in its scope the depiction and movement of two- or three-dimensional characters on two- or three-dimensional paths displayed in an interactive electronic medium.

DETAILED DESCRIPTION OF THE INVENTION

In a generic embodiment of the invention, N number of players each select M "companion" characters to move around a game board, which game board may be two-or three-dimensional and may comprise either a planar surface or a graphical electronic display. Each of the N players may play a single one of N companions, or, if the number of players N is fewer than the number of characters M, one or more players may play one or more characters. Another person may also be in charge of handing out money or cards, keeping track of Enlightenment Points (see below) and/or moving the main character along his path.

Figure 1:
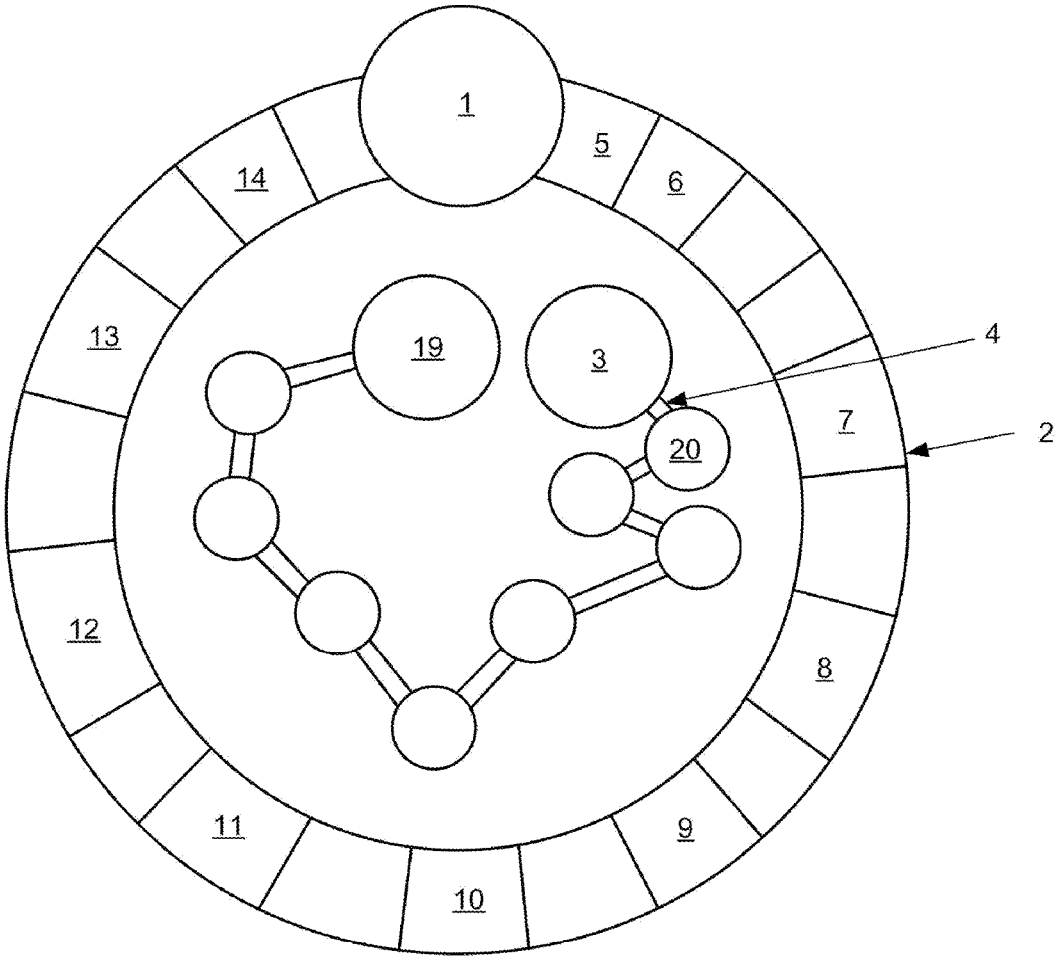
FIG. 1 illustrates a generic two-dimensional game board of the instant invention.

Referring now to the drawings, in which like elements are represented by like indicia in each drawing, FIG. 1 depicts a planar game board describing a generic configuration and play of the game. Play begins with the players selecting one or more of a plurality of "companion" characters and placing them on the companion start space 1 on a closed path 2. Each companion starts play with a first amount of "gold."

A main character figure, common to all players and determinative of who wins the game, is placed on the beginning space 3 of a journey path 4. In FIG. 1, the journey path 4 is shown placed inside closed path 2, but such placement is not necessary to the conduct of the game.

Movement along the closed path 2 begins with a starting player selecting a random number, for example by rolling a pair of dice (a "movement roll"). For convenience and not limitation, selection of a random number will henceforth be described as the roll of dice. The starting player moves his or her character in a clockwise direction around the closed path 2 the number of spaces corresponding to the total indicated by the upward faces of the dice. The number of spaces to be moved may vary from the dice roll according to the "ability" of the character as described further below.

Figure 6:
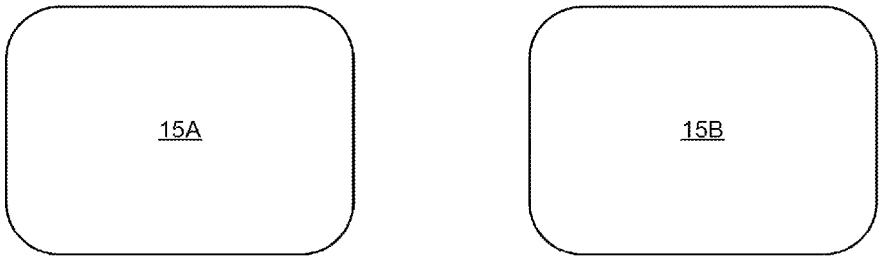
FIG. 6 shows the obverse and reverse of an exemplary Event card.
Figure 7:
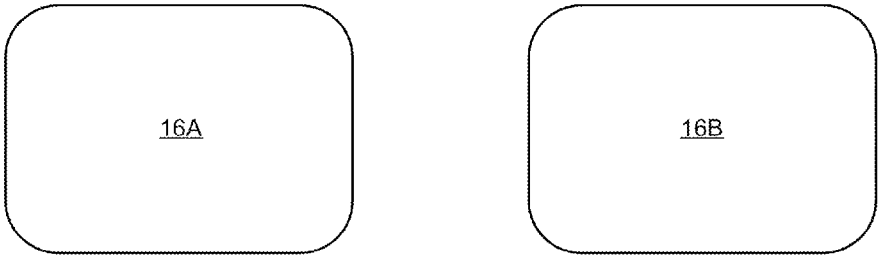
FIG. 7 shows the obverse and reverse of an exemplary Fortune card.

Within the scope of this invention, "counterclockwise" may be substituted for "clockwise," "left" for "right," and "top" for "bottom." The space reached by the first player's character on the first move on the closed path 2, or reached by any player on any move along the closed path 2, will put that player on at least one of a Fortune space 5, an Event space 6, a Bandit Cave space 7, a Royal Banquet space 8, a Switch space 9, a Disaster space 10, a Shrine space 11, a Demon Fortress space 12, a Peaceful Temple space 13, a Special Occurrence space 14 or the Start space 1. Landing on each of these spaces requires an action by the player landing on it, described as follows:

Event space 6—draw one Event card 15 (see FIG. 6);

Fortune space 5—draw one Fortune card 16 (see FIG. 7);

Bandit Cave space 7—character finds a cave hideout with a group of bandits and defeat them, picking up their treasure of a second amount of gold;

Royal Banquet space 8—character loses a first number of EP for greedily eating food;

Switch space 9—the player's character switches position with that of the character of the player seated to his/her left. The spaces the characters land on as a result of the switch are not activated;

Disaster space 10—character loses half his/her gold; this amount is always rounded down;

Shrine space 11—character may trade gold in the form of offerings for EP at the rate of a third amount of gold per EP, and up to a second number of EP may be earned in this way;

Demon Fortress space 12—the main character is captured, a Story (see below) may not be begun this turn;

Peaceful Monastery space 13—character pays homage to peaceful monks and gains a third number EP.

Special Occurrence space 14—one or more spaces that may be defined prior to or during game play to be added to the above spaces, or substituted for one or more of the above spaces.

Start space 1—each character collects a fourth amount of gold and a fourth number of EP upon landing on this space (except at the start of the game).

With the exception of the Start space, the above-listed spaces may, in the generic embodiment, be arranged in any order on the game board, as signified by blank spaces in FIG. 1 interspersed among the numbered ones.

The companion characters of the present invention, along with their "abilities" are two or more of:

Monkey—Because Monkey is the strongest fighter, his ability is to add a first integer to all rolls for the violent option of Event cards (or Stories if specified).

Pigsy—Because Pigsy is the greediest character, his ability is to place a first quantity of money traps on a space (except the starting and ending spaces) on the closed path 2. These traps steal a fifth amount of gold from any character that lands on them. There can only be a second quantity of traps at any given time on the board, each of which are sent back to Pigsy when landed on, and which can only be replaced at the start of Pigsy's turn. Only a third quantity of traps may be placed on a given space.

Sandy—Because Sandy is the most peaceful of the characters, his ability is to add a second integer to all rolls for the nonviolent option of the Events (or Stories if specified).

Dragon Prince—Because the Dragon Prince has the form of a horse, his ability is to add a third integer to all movement rolls, that is, random numbers determining movement along the closed path 2.

Special Characters—These characters have abilities that may be defined prior to or during game play to be added to the above characters, or substituted for one or more of the above characters.

When all of the players have had a first movement roll (a first round) the main character moves one space off the beginning space 3 to the adjacent Story space 20 along the journey path 4. In FIG. 1, the journey path 4 is drawn inside the closed path 2, but this is not essential to the play of the game.

Figure 2:
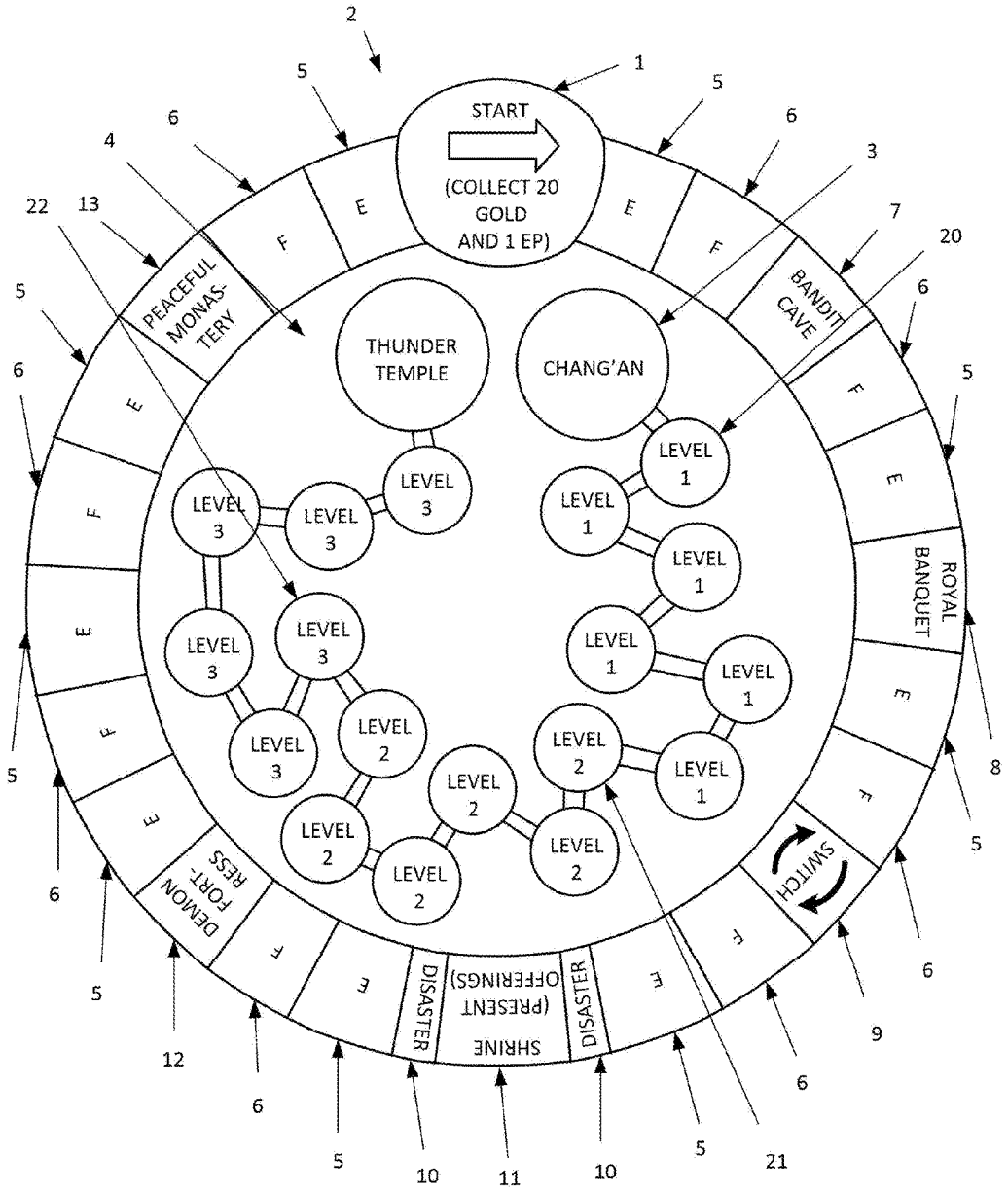
FIG. 2 illustrates the two-dimensional game board of the preferred embodiment of the instant invention.
Figure 3:
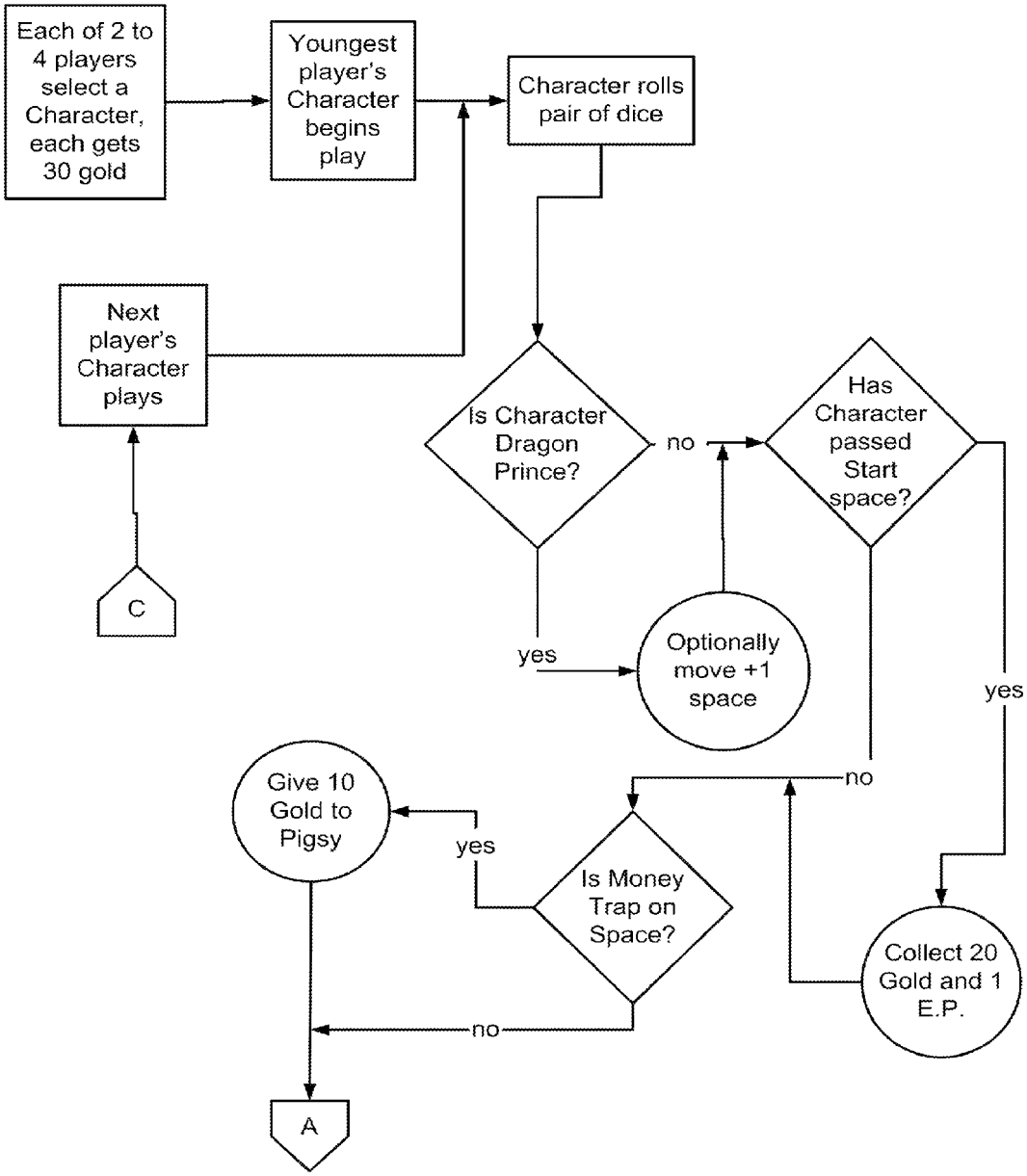
FIG. 3 is a flow diagram showing approximately the first one-third of the basic game play logic of the preferred embodiment.
Figure 4:
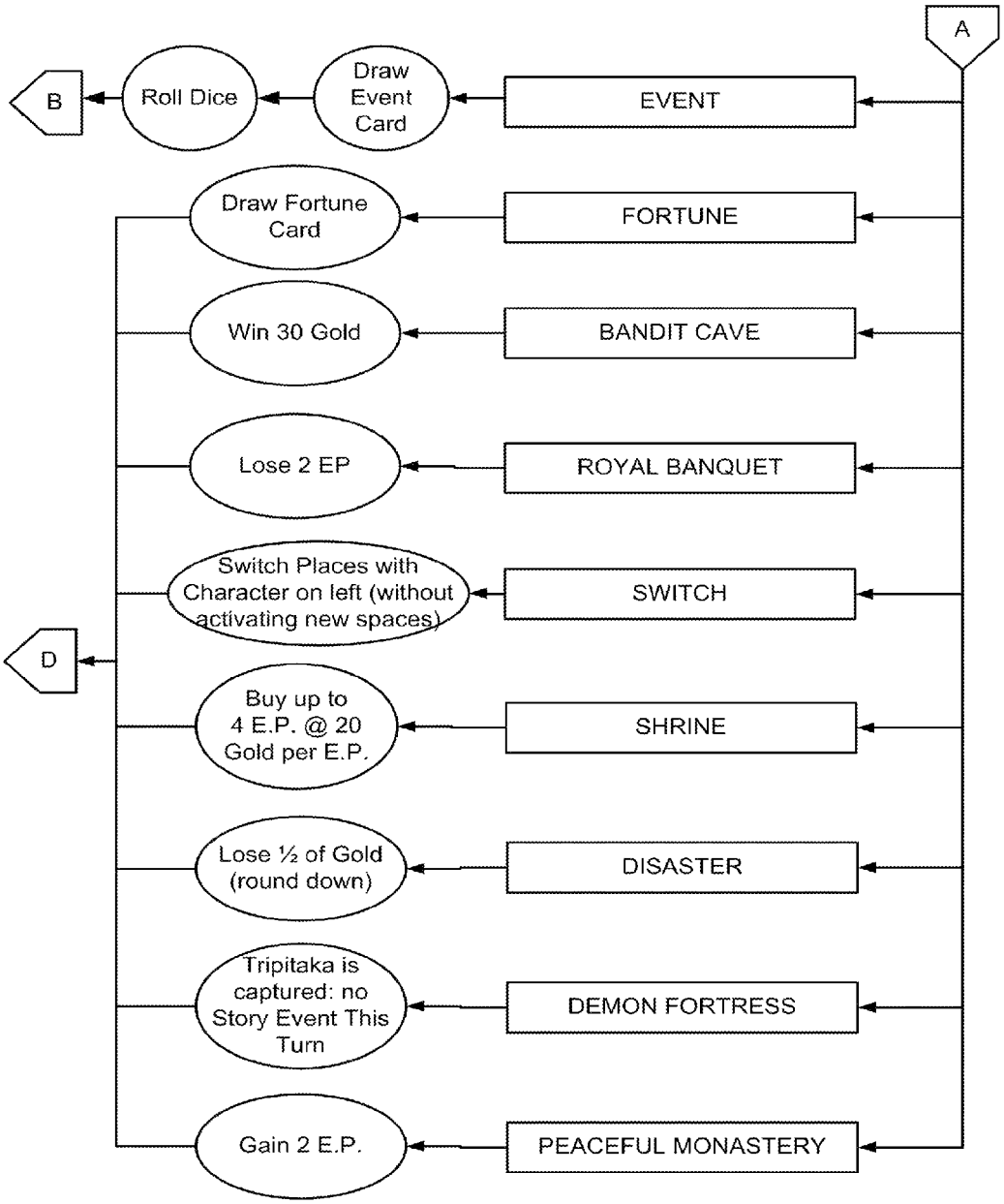
FIG. 4 is a flow diagram showing approximately the second one-third of the basic game play logic of the preferred embodiment.
Figure 5:
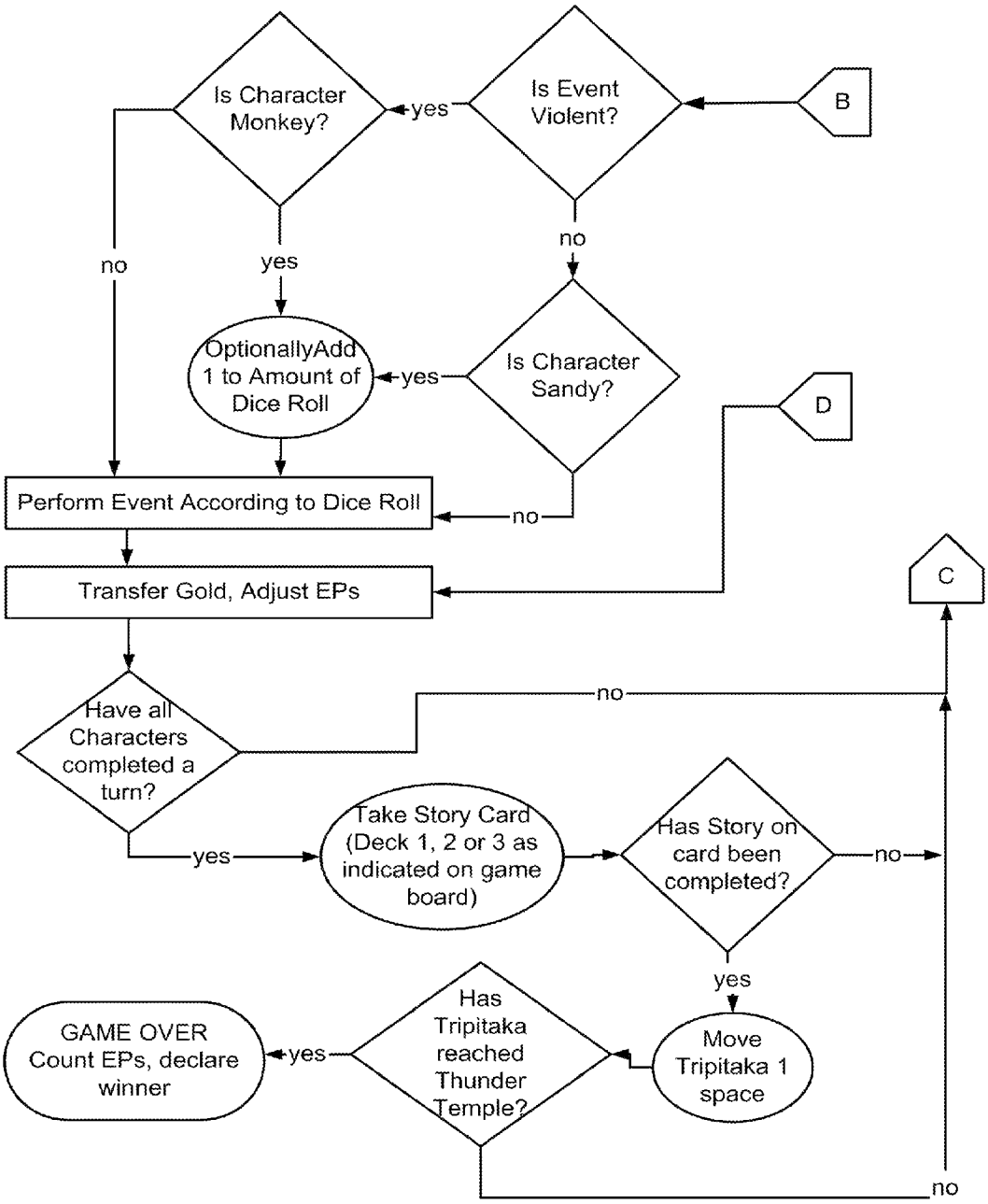
FIG. 5 is a flow diagram showing approximately the final one-third of the basic game play logic of the preferred embodiment.

Upon movement to this first (and subsequent) Story space(s), the players draw a Story card 16 (see FIG. 9) which specifies conditions which must be met before the main character can move to the next Story space (shown as blank circles in FIG. 2). The main character does not advance until the conditions of the current Story have been met.

Figure 8:
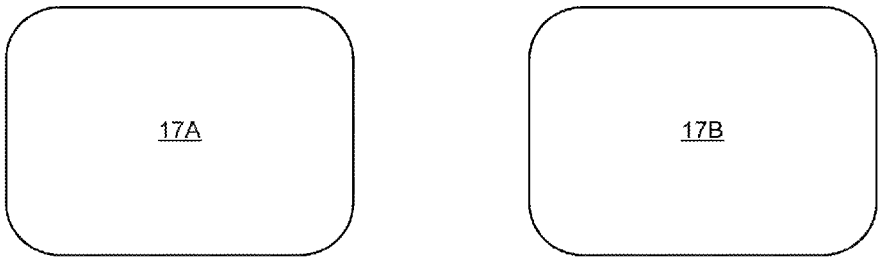
FIG. 8 shows the obverse and reverse of an exemplary Story card.

The Story cards 17 (see FIG. 8) may come from one or more Story card decks, each of which may specify Stories of different levels of complexity. The obverse 17A of the Story card 17 may be printed, by means of example and not limitation, with "Story Card" or "Story Event Card," or "Story Event LVL Z" in the case of a game in which there are Z levels of complexity of Stories. The reverse 17B of the Story card 17 contains a brief Story containing one or more goals to be achieved by one or more players before the main character.

Figure 9:
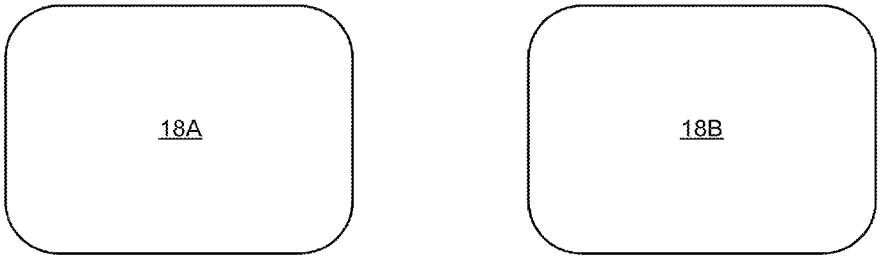
FIG. 9 shows the obverse and reverse of an exemplary Treasure card.

At any time during a player's turn, he or she may buy a treasure card (see FIG. 9).

The game ends when the main character reaches the final journey space 19. At that point, the game is over and all players must then tally up all EPs they have received. The winner is determined by which player has the highest number of EPs.

FIG. 2 is an illustration of the game board of the preferred embodiment of the invention. The preferred embodiment has at least the four companion characters Monkey, Pigsy, Sandy and Dragon Prince noted above, with the main character being Tripitaka. The "abilities" of the companions in the preferred embodiment are defined more specifically as follows:

Monkey—Because Monkey is the strongest fighter, his ability is to add a first integer equal to one to all rolls for the violent option of Event cards (or Story cards, if a violent option is specified).

Pigsy—Because Pigsy is the greediest character, his ability is to place a first quantity of money traps equal to two on a space (except the starting and ending spaces) on the closed path 2. These traps steal a fifth amount of gold equal to ten per trap from any character that lands on them. There can only be a second quantity of traps equal to two traps at any given time on the board, each of which are sent back to Pigsy when landed on, and which can only be replaced at the start of Pigsy's turn. Only a third quantity of traps equal to one may be placed on a given space.

Sandy—Because Sandy is the most peaceful of the characters, his ability is to add a second integer equal to one to all rolls for the nonviolent option of the Event cards (or Story cards, if a nonviolent option is specified).

Dragon Prince—Because the Dragon Prince has the form of a horse, his ability is to add a third integer equal to one to all movement rolls, that is, random numbers determining movement along the closed path 2.

In the preferred embodiment, there is no added Special Character.

Up to four players may play at a time, each selecting one or two of the companion characters. Thus, in addition, to having four players each play one companion, it is possible to have two or three players each select one companion, leaving out the other one or two companions, or have two players each play two companions.

Another person may also be in charge of taking in and dispensing "gold" from a "bank," handing out cards, keeping track of Enlightenment Points, and/or moving the Tripitaka character along the Journey path 4. Each companion starts play with a first amount of "gold" equal to 30 gold.

FIG. 2 shows the closed path 2 with a specific arrangement of spaces including Start space 1, Fortune spaces 5, Event spaces 6, Bandit Cave space 7, Royal Banquet space 8, Switch space 9, Disaster spaces 10, Shrine space 11, Demon Fortress space 12, and Peaceful Temple space 13 as shown. No Special Occurrence space 14 is utilized in the preferred embodiment. The following is a detailed description of the operation of these spaces when landed upon by a companion character. Some of the spaces involve the drawing of an associated card.

FORTUNE SPACES/FORTUNE CARDS

When a player lands on a Fortune space 5, he/she draws a Fortune card 16 (See FIG. 7) from a deck of like cards. The effect of the card drawn activates immediately, unless otherwise specified on the card. Some of these cards may be held indefinitely and have permanent or reusable effects, while others are one-time use cards.

An example of a Fortune card 16 is shown in FIG. 7. The obverse 16A of a Fortune card 16 is imprinted, by way of example and not limitation, with "Fortune Card" or "Fortune." The reverse 16B is imprinted, by way of example and not limitation, You bully the other disciples! Roll one die. Multiply that number by 10.

Take that amount of gold from every other player.

Once used or discarded, Fortune cards 16 should be returned to the bottom of the Fortune card deck.

EVENT SPACES/EVENT CARDS

When a player lands on an Event space 6, he/she draws an Event card 15 (See FIG. 6) from a deck of like cards. Events are activated immediately, and most Event cards 15 will present the player with several options regarding how to complete the Event. There will always be a violent option and a nonviolent option on the card. For both the violent and nonviolent options of the Event card 15, a player must use both dice to beat a number listed on the Event card for either of those options. Successful completion of the Event can have different rewards based on the option chosen to complete it. For choosing a fighting or violent option a player may receive a certain amount of gold. For choosing a nonviolent option a player will receive EPs. Event cards are the principal way a player will receive either money or EPs. If a player fails to successfully complete an Event, he/she receives no reward for the Event. Some more challenging Events may present a bribe option, in which case, if the player fails on either die roll chosen, he/she must lose the amount indicated by the bribe. If he/she doesn't have enough gold to pay, he/she pays with all his/her remaining gold.

An example of an Event card 15 is shown in FIG. 6. The obverse 15A of an Event card 15 is imprinted, by way of example and not limitation, with "Event Card" or "Event." The reverse 15B is imprinted, by way of example and not limitation, Magic Fish Appears!

Eat or Release.

Roll higher than 5 to Eat: gain 15 gold and lose 1 E.P.

Roll higher than 4 to Release: gain 2 E.P. and draw 1 Fortune card.

Once drawn and their events completed, Event cards 15 should be returned to the bottom of the Event card deck.

Bandit Cave space 7—character finds a cave hideout with a group of bandits and defeat them, picking up their treasure of a second amount of gold equal to 30 gold;

Royal Banquet space 8—character loses a first number of EP equal to two EP for greedily eating food;

Switch space 9—the player's character switches position with that of the character of the player seated to his/her left. The spaces the characters land on as a result of the switch are not activated;

Disaster space 10—character loses half his/her gold; this amount is always rounded down;

Shrine space 11—character may trade gold in the form of offerings for EP at the rate of a third amount of gold equal to 20 gold per EP, and up to a second number of EP equal to 4 EP may be earned in this way;

Demon Fortress space 12—Tripitaka is captured, a Story (see below) may not be begun this turn;

Peaceful Monastery space 13—character pays homage to peaceful monks and gains a third number of EP equal to two EP.

Start space 1—Each character collects a fourth amount of gold equal to 20 gold, and a fourth number of EPs equal to one EP, upon landing on the Start space 1 (not including the beginning of the first round).

ENLIGHTENMENT POINTS

The goal of the game is to become the character that finishes with the most EPs. These EPs may be received in many different ways, but are chiefly received by choosing the nonviolent options of Event cards. They may also be received from Fortune cards, Treasure cards, certain other spaces, or Story cards.

Certain events may cause you to lose EPs as a penalty or allow a player to use the EPs as a currency to pay for an action. No matter how many times you are penalized, you can never go below zero EPs.

GOLD

Gold is mainly earned through fighting enemies on Event cards, though it can be gained in other ways, such as by operation of Fortune cards. The main purpose of gold is to buy Treasure cards or for use in bribes to complete Events or Stories. Gold may optionally be denominated into copper coins (worth one gold), silver coins (worth five gold), and gold coins (worth ten gold).

In the preferred embodiment, gold is kept in a "bank" and any money lost during game play through Event bribes, Treasure card purchases, or any other losses (not including those that go to a specific character) must be returned to the "bank."

TREASURE CARDS

Treasure cards have very special bonuses on them that can be helpful in winning the game. Treasure cards may only be purchased for the exact gold amount indicated.

Some Treasure cards may only be used once. Others may be used for a certain number of times. When these Treasures are used up, they must be placed back with the other unused Treasure cards, and are thereafter able to be purchased again. Certain other Treasure cards have permanent or reusable effects and are kept by the character. A player may have up to two Treasure cards at a time. In order to receive a new Treasure card a player must discard one of his/her current cards.

An example of a Treasure card 18 is shown in FIG. 9. The obverse 18A of a Treasure card 18 is imprinted, by way of example and not limitation, with "Treasure Card" or "Treasure." The reverse 18B is imprinted, by way of example and not limitation, Teachings of the 72 Earthly Transformations You have learned to transform into any man, animal, or object- even the creature your opponent is fighting...

Activate this card at any time your opponent begins an Event. Roll 2 dice. This is the number your opponent must beat to succeed. If they fail, you receive the power indicated by the card. They may not take a bribe option. When used three times, this card must be returned to the Treasure deck.

Price: 55 gold

In the preferred embodiment, the journey path 4 is placed inside the closed path 2. At the end of the first round of movement rolls (that is, all characters completing one movement roll) the Tripitaka character moves one space off the beginning space "Chang'an" 3 to the adjacent space 20 along the journey path 4. The first adjacent space 20 is a level I Story space, which triggers the drawing (by anyone) of a level I Story card 17 (see FIG. 8).

The obverse 17A of the Story card 17 may be printed, by means of example and not limitation, with "Story Card 1" or "Story Event Card 1," or "Story Event LVL 1." The reverse 17B of the Story card 17 contains a brief Story containing one or more goals to be achieved by one or more players before the main character. Story cards, by means of example and not limitation, may contain a quote of something said by a character and/or a description of an occurrence, followed by an instruction to one or more of the players, e.g., "Such wonderful and splendid weapons. Who do they belong to, and why are they laying here, I wonder? What luck, this is my chance! I will take them!"

As Tripitaka's disciples leave their weapons to be copied by blacksmiths, the spirit Tawny Lion steals them in the night.

All players must discard their Treasure cards. Now each player must roll 2 dice. If one of those rolls is above 4, they may reclaim their Treasures. If the roll fails, the event is still cleared, but the players do not reclaim their Treasures.

Figure 10:
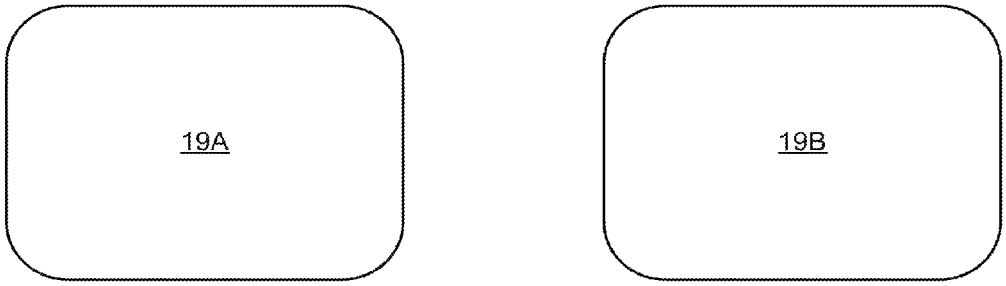
FIG. 10 shows the obverse and reverse of an exemplary second level Story card.
Figure 11:
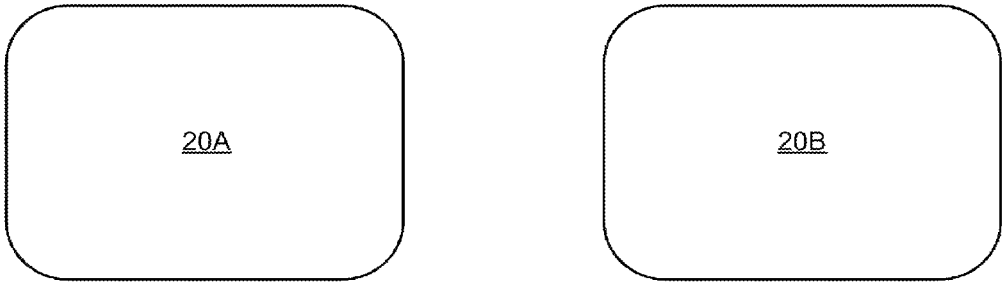
FIG. 11 shows the obverse and reverse of an exemplary third level Story card.

Note in FIG. 2 that following a plurality of level I Story spaces, level II Story spaces 21 begin. Level 2 Stories are more complex than level I Stories. FIG. 10 shows the obverse 19A and reverse 19B of a level 2 Story card. The obverse 19A of the Story card 19 may be printed, by means of example and not limitation, with "Story Card 2" or "Story Event Card 2," or "Story Event LVL 2." The reverse 19B of the Story card 19, like the reverse 17B of a Story card 17, contains a brief Story containing one or more goals to be achieved by one or more players before the main character may advance. Following level II Stories 21 are optionally a plurality of level III Stories 22, which are more complex still. FIG. 11 shows the obverse 20A and reverse 20B of a level 3 Story card. The obverse 20A of the Story card 20 may be printed, by means of example and not limitation, with "Story Card 3" or "Story Event Card 3," or "Story Event LVL 3." The reverse 20B of the Story card 20, like the reverse 17B of a Story card 17, contains a brief Story containing one or more goals to be achieved by one or more players before the main character may advance.

Further optional Story spaces may ensue. The preferred embodiment has three levels of Story complexity; more than three or fewer than three are optional additional embodiments of the present invention.

Stories from Story cards are activities that must be completed before Tripitaka may advance to the next Story space 20 (or 21, etc.). Optionally, the activities must also be completed before the end of the ensuing round, lest all of the pending story activities be begun anew. At the end of each round, Tripitaka will attempt to move along journey path 4 (on the center spaces in FIG. 2) during a Story and get closer to the Thunder Temple, which upon reaching, ends the game.

When Tripitaka finally makes his way to the Thunder Temple, the game is over and all players must then tally up all EPs they have received. The winner is determined by which player has the highest amount of EPs.

The invention claimed is:

1. A method of play of a game for a plurality of players using an apparatus for a game for a plurality of players, comprising a random number generator, an amount of currency, a two-dimensional playing surface, a closed first path on the surface having a first start space and a plurality of concatenated first path spaces along the first path beginning with, and including, the first start space and ending adjacent to the first start space, the first path spaces each having one of a plurality of action identifiers, a plurality of companion characters, each represented by a unique companion character game piece, for moving along the first path, a second path on the surface having a second start space and a plurality of concatenated second path spaces alone the second path beginning with the second start space and ending on an end-of-game space, and the second path spaces each having one of a plurality of story identifiers, a main character, represented a main character game piece, for moving along the second path, a plurality of action card decks of action cards, each action card deck being identified by at least one action card descriptor; and containing an action instruction for at least one of the plurality of companion characters, at least one story card deck of story cards, each story card deck being identified by at least one story card descriptor and containing a story instruction for at least one of the plurality of companion characters, at least one treasure card deck of treasure cards, each treasure card deck being identified by at least one treasure card descriptor and describing a valuable attribute for the companion character who owns it, and its price in an amount of currency, comprising the steps of:

(a) the plurality of players each choosing at least one of the companion character game pieces, each of the companion character game pieces representing a companion character;
at least one of which is under the control of one player;
(b) the companion character game pieces all being placed on the first start space;
(c) the main character game piece being placed on the second start space;
(d) each of the companion characters being initially assigned equal first amounts of the currency;
(e) the order of play among the plurality of players being determined according to instructions for play;
(f) a first one of the plurality of players designated by the order of play generates a random number using a random number generator;
(g) the first player makes a move of one of the at least one companion characters, represented by the motion of a first one of the companion character game pieces;
a move comprising
advancement of the first one of the companion character game pieces along said first path a number of said first path spaces being a first function of the random number;
the performance of whichever action being described on the first path space upon which the at least one companion character lands;
the accumulation of a first number of at least zero points by the companion character; and
buying at least zero of said treasure cards for an amount of the currency stated on each card;
(h) the next player continues game play by making a move of another of the at least one companion characters under his/her control, until all of the plurality of companion characters has completed a move;
(i) a player takes a story card from one of said plurality of story card decks, and at least one of-the companion characters must follow said story instruction;
(j) when the required story instructions stated on the story card are completed, the main character is moved one space away from the second start space along the second path;
(k) play being resumed at step (f) and continuing through step (j), until the main character reaches the end-of-game space;
(l) the number of points accumulated by each of the companion characters being totaled; and
(m) the companion character having accumulated the greatest number of points winning the game.

2. The method of play of claim 1, in which:
said first function is to add one to said random number.

3. A method of play of a game for a plurality of players using an apparatus for a game for a plurality of players, comprising a random number generator, an amount of currency, a two-dimensional playing surface, a closed first path on the surface having a first start space and a plurality of concatenated first path spaces along the first path beginning with, and including, the first start space and ending adjacent to the first start space, the first path spaces each having one of a ten action identifiers, arbitrarily called AI7, AI8, AI9, AI10, AI11, AI12, AI13, AIE, and AIF, four distinct companion characters arbitrarily called A, B, C, and D, each represented by a unique companion character game piece, for moving along the first path, a second path on the surface having a second start space and a plurality of concatenated second path spaces alone the second path beginning with the second start space and ending on an end-of-game space, and the second path spaces each having one of a plurality of story identifiers, a main character, represented a main character game piece, for moving along the second path, a plurality of action card decks of action cards, each action card deck being identified by two action card descriptors, arbitrarily called E and F, and containing an action instruction for at least one of the plurality of companion characters, at least one story card deck of story cards, each story card deck being identified by three story card descriptors arbitrarily called S1, S2, and S3 and containing a story instruction for at least one of the plurality of companion characters, at least one treasure card deck of treasure cards, each treasure card deck being identified by a treasure card descriptor arbitrarily called T describing a valuable attribute for the companion character who owns it, and its price in an amount of currency, comprising the steps of:

(a) the plurality of players each choosing at least one of the companion character game pieces representing at least one companion character under the control of one player;
(b) the companion character game pieces all being placed on the first start space;
(c) the main character game piece, representing the main character, being placed on-a second start space;
(d) each of the companion characters being initially assigned equal first amounts of the currency;
(e) the order of play among the plurality of players being selected according to the rules of the game;
(f) the player representing companion character A placeing at least one money trap on at least one of the first path spaces;
(g) a first player designated by the order of play generating a random number using the random number generator;
(h)(1) the first player making a move of one of the four companion characters, a move defined from the list of:
(h)(1)(A) advancement of any one of three companion characters A, B and C, along the first path a number of first path spaces equal to the random number; and (h)(1)(B) advancement of the companion character D a number of first path spaces equal to the random number, optionally plus a first integer; and the performance of whichever action being identified by the action identifier on the first path space upon which the companion character lands; and the accumulation of at least zero points by the companion character;

(i) the next player continueing game play by making a move of another of the at least one companion characters under his/her control;

(j) any of the companion characters, upon landing on the start space, collecting a fourth amount of currency and a fourth amount of points for that companion character;

(k) any of the companion characters, upon landing on a first path space containing a money trap being required to give companion character A a fifth amount of currency;

(l) when all of the companion characters have completed a move, a player taking a story card from one of said story card decks, and at least one of the companion characters-being required to follow the story instruction on the story card;

(m) when the story instruction is completed, the main character being moved one space away from the second start space along the second path;

(n) play being resumed at step (g) and continueing through step (m), until the main character game piece reaches the end-of-game space;

(o) the number of points accumulated by each of the companion characters being totaled; and (p) the companion character having accumulated the greatest number of points winning the game.

4. The method of claim 3, further comprising steps after step (h)(1) of:

(h)(2) companion characters performing actions according to said action identifiers taken from the list of:

(h)(2)(A) action identifier AI7 means said companion character wins a second amount of currency;

(h)(2)(B) action identifier AI8 mean said companion character loses a first number of points;

(h)(2)(C) action identifier AI9 means said companion character switches spaces with a companion character of another player;

(h)(2)(D) action identifier AI10 means said companion character loses one-half of its currency, rounding down;

(h)(2)(E) action identifier AI11 means said companion character may buy up to a second number of points at a price of a third amount of currency per point;

(h)(2)(F) action identifier AI12 means said step (1) is void;

(h)(2)(G) action identifier AI13 means said companion character gains a third number of points;

(h)(2)(H) action identifier AIE means said companion character draws a card from said action descriptor card deck E; selects a random number, and performs instruction E;

(h)(2)(I) action identifier AIF means said companion character draws a card from said action descriptor card deck F and performs instruction F.

5. The method of claim 4, further comprising steps after step (h)(2)(H) taken from the list of:

(h)(2)(H)(i) said companion character is B, and B selects the nonviolent option, and the integer required in instruction E is said random number;

(h)(2)(H)(ii) said companion character is B, and B selects the violent option, and the integer required in instruction E is a second function of said random number;

(h)(2)(H)(iii) the companion character is C, and C selects the nonviolent option, and the integer required in instruction E is the second function of said random number;

(h)(2)(H)(iv) the companion character is C, and C selects the violent option, and the integer required in instruction E is said random number;

(h)(2)(H)(v) the companion character is A, and the integer required in instruction E is said random number; and (h)(2)(H)(vi) the companion character is D, and the integer required in instruction E is said random number.

6. The method of claim 4, further comprising steps after step (1) taken from the list of:

(1)(A) said story instruction on said story card involves the exchange of currency; and (1)(B) said story instruction on said story card involves the exchange of points.

7. The method of claim 5, in which:

said second function is to add one to said random number.

* * * * *